US012070144B2

(12) United States Patent
Baker

(10) Patent No.: US 12,070,144 B2
(45) Date of Patent: Aug. 27, 2024

(54) GARMENT HANGER ATTACHMENT DEVICE FOR HOODED GARMENTS

(71) Applicant: Scott Stacy Baker, Poulsbo, WA (US)

(72) Inventor: Scott Stacy Baker, Poulsbo, WA (US)

( * ) Notice: Subject to any disclaimer, the term of this patent is extended or adjusted under 35 U.S.C. 154(b) by 73 days.

(21) Appl. No.: 17/967,007

(22) Filed: Oct. 17, 2022

(65) Prior Publication Data

US 2023/0033334 A1 Feb. 2, 2023

Related U.S. Application Data

(63) Continuation-in-part of application No. 17/161,176, filed on Jan. 28, 2021, now abandoned.

(60) Provisional application No. 62/969,013, filed on Jan. 31, 2020.

(51) Int. Cl.
*A47G 25/28* (2006.01)

(52) U.S. Cl.
CPC ..... *A47G 25/28* (2013.01)

(58) Field of Classification Search
CPC ..... A47G 25/28; A47G 25/20; A47G 25/18; A47G 25/32; A47G 25/16; A47G 25/183; A47G 25/186; A47G 25/14
See application file for complete search history.

(56) References Cited

U.S. PATENT DOCUMENTS

| | | | | |
|---|---|---|---|---|
| 609,743 | A | 8/1898 | Heaton | |
| 2,593,356 | A | 4/1952 | Smith | |
| D253,447 | S | 11/1979 | Tully | |
| D279,051 | S | 6/1985 | Shockley | |
| D283,376 | S | 4/1986 | McConnell | |
| 5,022,569 | A | 6/1991 | Beaulieu | |
| D398,159 | S | 9/1998 | Garrett | |
| D411,051 | S | 6/1999 | Hales | |
| 7,611,034 | B1 * | 11/2009 | Peterson | A47G 25/60 211/115 |
| 8,944,298 | B2 | 2/2015 | Hickey | |
| 9,854,924 | B2 | 1/2018 | Klermund | |
| 9,930,984 | B1 | 4/2018 | Holmes | |
| 11,246,439 | B2 | 2/2022 | Hardin | |
| 11,278,141 | B2 | 3/2022 | Fox | |
| 11,291,322 | B2 | 4/2022 | Jones | |
| 2010/0122961 | A1 | 5/2010 | Moreau | |
| 2012/0103029 | A1 | 5/2012 | Darwin | |
| 2020/0305626 | A1 * | 10/2020 | Yau | A47G 25/482 |

FOREIGN PATENT DOCUMENTS

KR 20150002745 U 7/2015

* cited by examiner

*Primary Examiner* — F Griffin Hall

(57) ABSTRACT

A garment hanger attachment device for hooded garments that includes a main body, a shaped structural member, a swivel hook, a garment hood support, and a hanger attachment mechanism. The user can hang a hooded garment on a traditional clothes hanger, then attach the clothes hanger to the hanger attachment mechanism. Once in place, the hood of the garment can be pulled up to rest on the garment hood support allowing the hood to rest in a natural state. The swivel hook allows the garment hanger attachment device to rotate freely when hung. The shaped structural member is supported by structural cross webbing to prevent torquing or breaking.

19 Claims, 7 Drawing Sheets

GARMENT HANGER ATTACHMENT DEVICE FOR HOODED GARMENTS

FIELD OF THE INVENTION

The present invention relates generally to garment hanging devices. Specifically, the present invention relates to a garment hanger for hooded garments with a hood that is integral to the garment.

BACKGROUND OF THE INVENTION

Garments need to hang after use for drying and storage, the process of which can damage a garment over time. For example, creases may appear in the material of the neck and hood areas after hanging garments with an attached hood for prolonged periods of time. This damage is caused by the hood laying down while at rest during storage on traditional garment hangers. This creasing compromises the material by accelerating the deterioration of the garment material, which limits the insulating effects and will increase the likelihood of stretching and tearing of the material. Thus, there exists a need for a way to safely hang a hooded garment without compromising the integrity of its material. Other existing hangers do not address the needs of hooded garments, which are particularly susceptible from damage due to the hanging process, as hoods are often designed to create an insulating environment from inclement or hazardous environments. For example, submersion garments for trips below sea level typically have extreme pressure sensitive materials that require proper maintenance and storage. Failure to properly store the garment can result in severe damage to the insulating and protective properties of the garment.

The present invention aims to fill this need for a way to safely store hooded garments without comprising the integrity of the hood. The present invention provides a user with the ability to hang a hooded garment with the hood in an upright position, which allows the material to rest in a natural and relaxed state. This reduces stress on the material and avoids comprising the material. The present invention accomplishes this through use of a shaped structural member and a garment hood support.

SUMMARY OF THE INVENTION

The present invention is a garment hanging device adapted to be specifically used with hooded garments. To this end, the garment hanging device comprising a main body, a shaped structure member, a garment hoods support, a hanger attachment mechanism, and a swivel hook.

The user may hang a hooded garment on a traditional clothes hanger, and then attach the clothes hanger to the present invention using the hanger attachment mechanism. The user may then pull the hood of the garment up and over the garment hood support located above the main body of the garment hanging device. The garment hood support is a curved surface that creates a location for the hood of the garment to naturally rest without creating undue strain on the hood's material.

The main body of the present invention is supported by a shaped structural member. The shaped structural member comprises an inner cavity and a curved outer edge, these two components forming a uniform curve upwards that ends in a flat portion, the flat portion being positioned above the garment hood support. The shaped structural member is further supported by structural cross webbing that runs between the inner cavity and the curved outer edge, enabling the present invention to support the full weight of a heavy garment without torquing, bending, or breaking. A swivel hook is positioned on the flat portion, allowing the invention to hang from a closet crossbar and rotate freely to achieve any orientation desired by the user. When a desired orientation is achieved, the swivel hook may be tightened with a locking nut, preventing the swivel hook from rotating further.

DETAILED DESCRIPTIONS OF THE INVENTION

Figure 1:
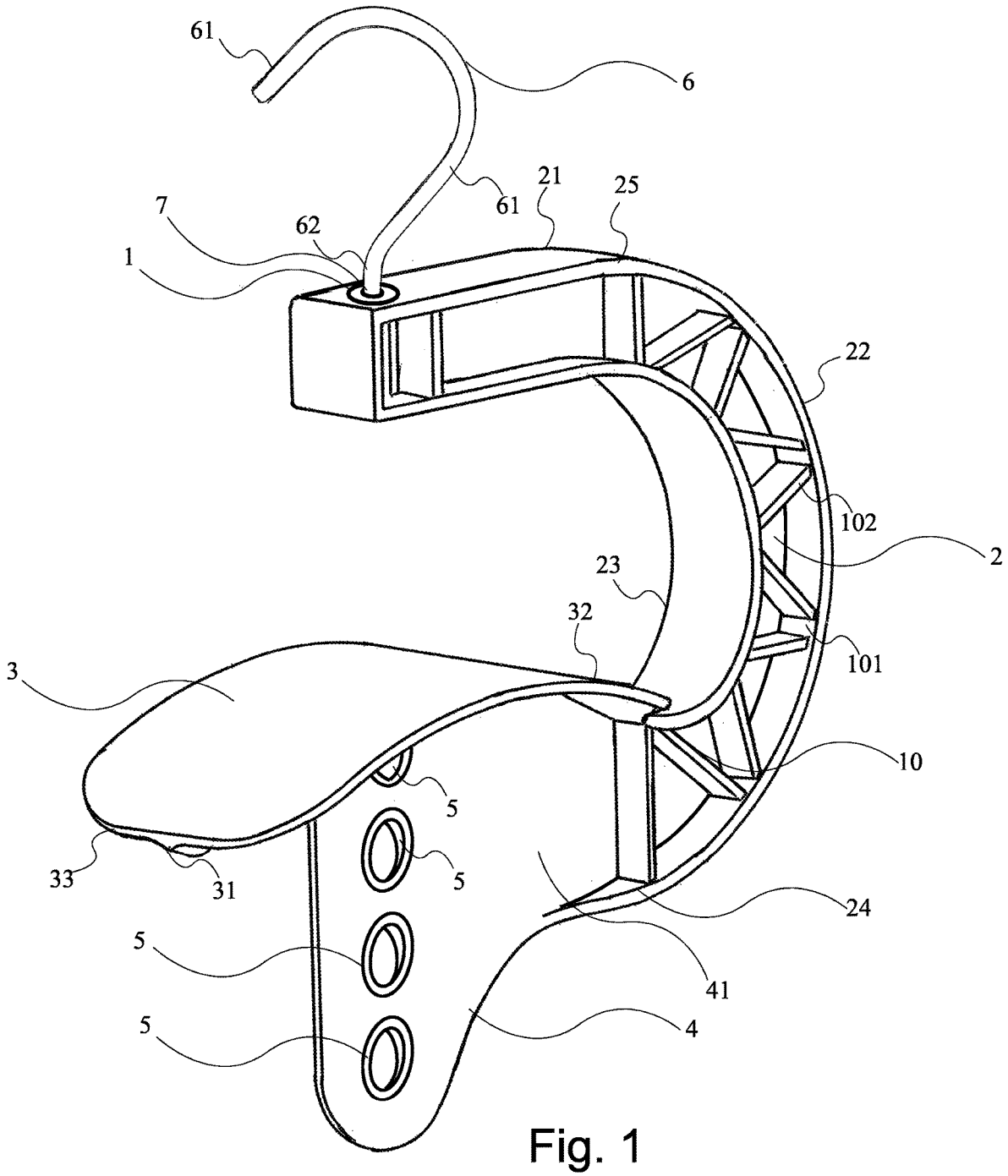
FIG. 1 shows an isometric view of the present invention.

All illustrations of the drawings are for the purpose of describing selected versions of the present invention and are not intended to limit the scope of the present invention.

The present invention is a garment hanger attachment device intended to receive hooded garments of different sizes to provide a resting place for the hood of the garment to avoid damage from improper storage.

The garment hanger attachment device comprises a main body 4, a swivel hook attachment hole 1, a shaped structural member 2, a garment hood support 3, a hanger attachment mechanism 5, a swivel hook 6, a top washer 7, a bottom washer 8, a bottom locking nut 9, and structural cross webbing 10.

In the ideal embodiment of the present invention, the main body 4 of the present invention comprises a single contiguous piece of material such as plastic, metal, or wood. The main body 4 has a central vertical flat section 41 that serves as a location for the hanger attachment mechanism 5 to be positioned. The main body 4 is contiguously attached to the shaped structural member 2 at one end. The use of a plurality of hanger attachment mechanisms 5 is contemplated by the present invention. Each of the plurality of hanger attachment mechanisms 5 are positioned to be spaced vertically to accommodate many different sizes of hooded garments, such that the user may select one of the plurality of hanger attachment mechanisms 5 based on the size of the garment and the associated hood. This ensures that the present invention can accommodate many different sizes of hooded garment to allow the hood to rest naturally on the garment hood support 3, regardless of the size of the garment.

Figure 2:
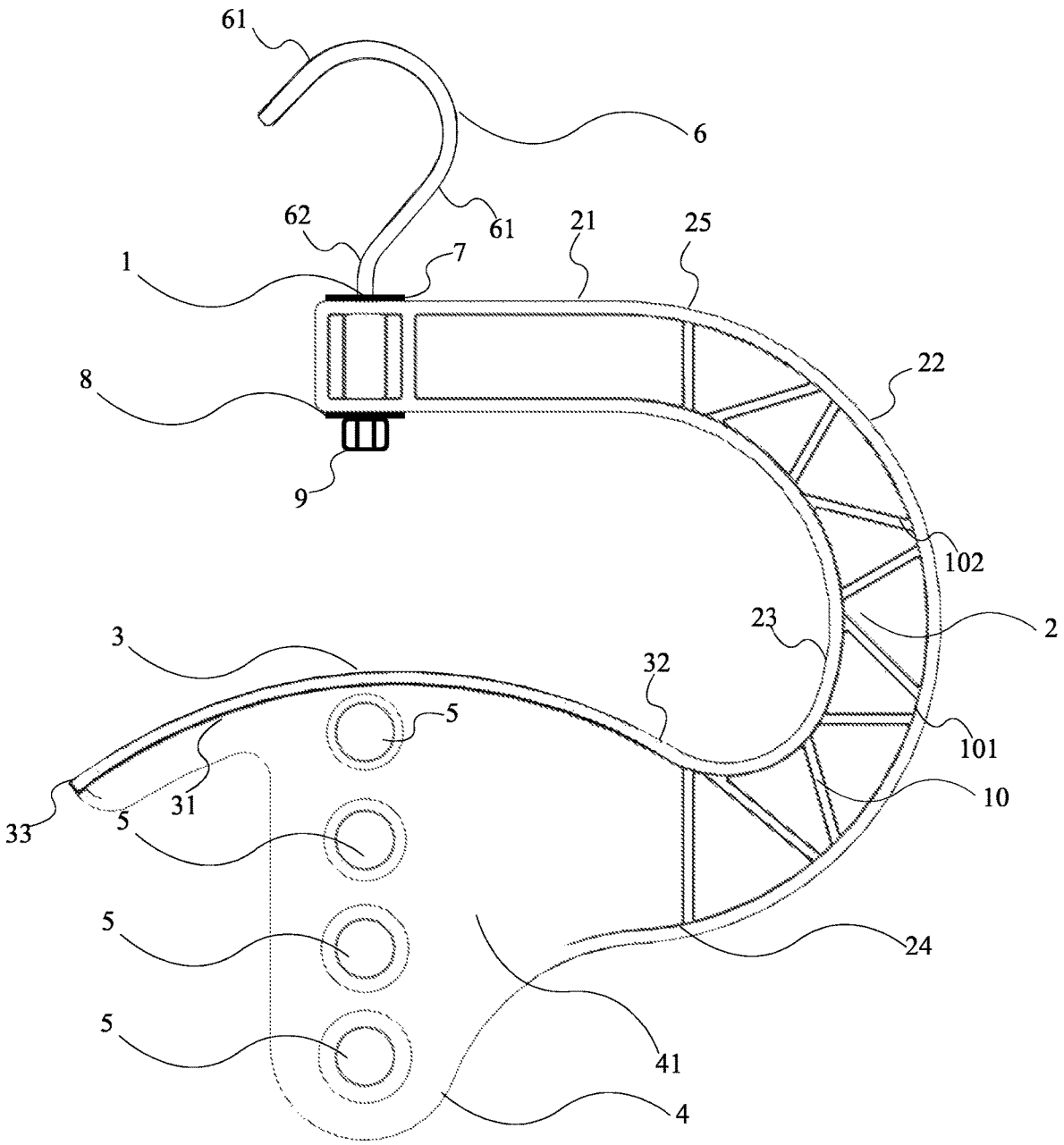
FIG. 2 shows a right side view of the present invention.
Figure 3:
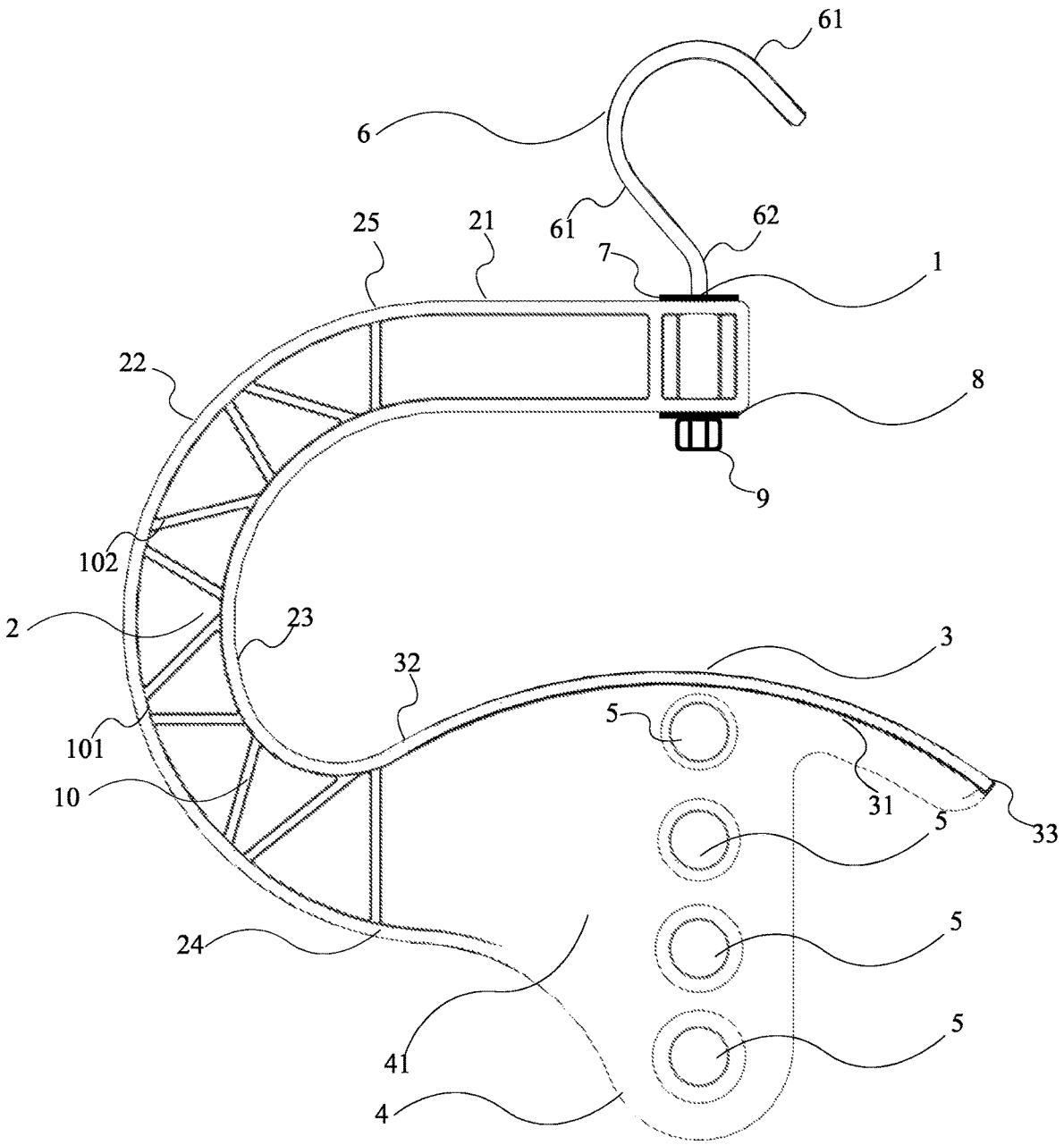
FIG. 3 shows a left side view of the present invention.
Figure 4:
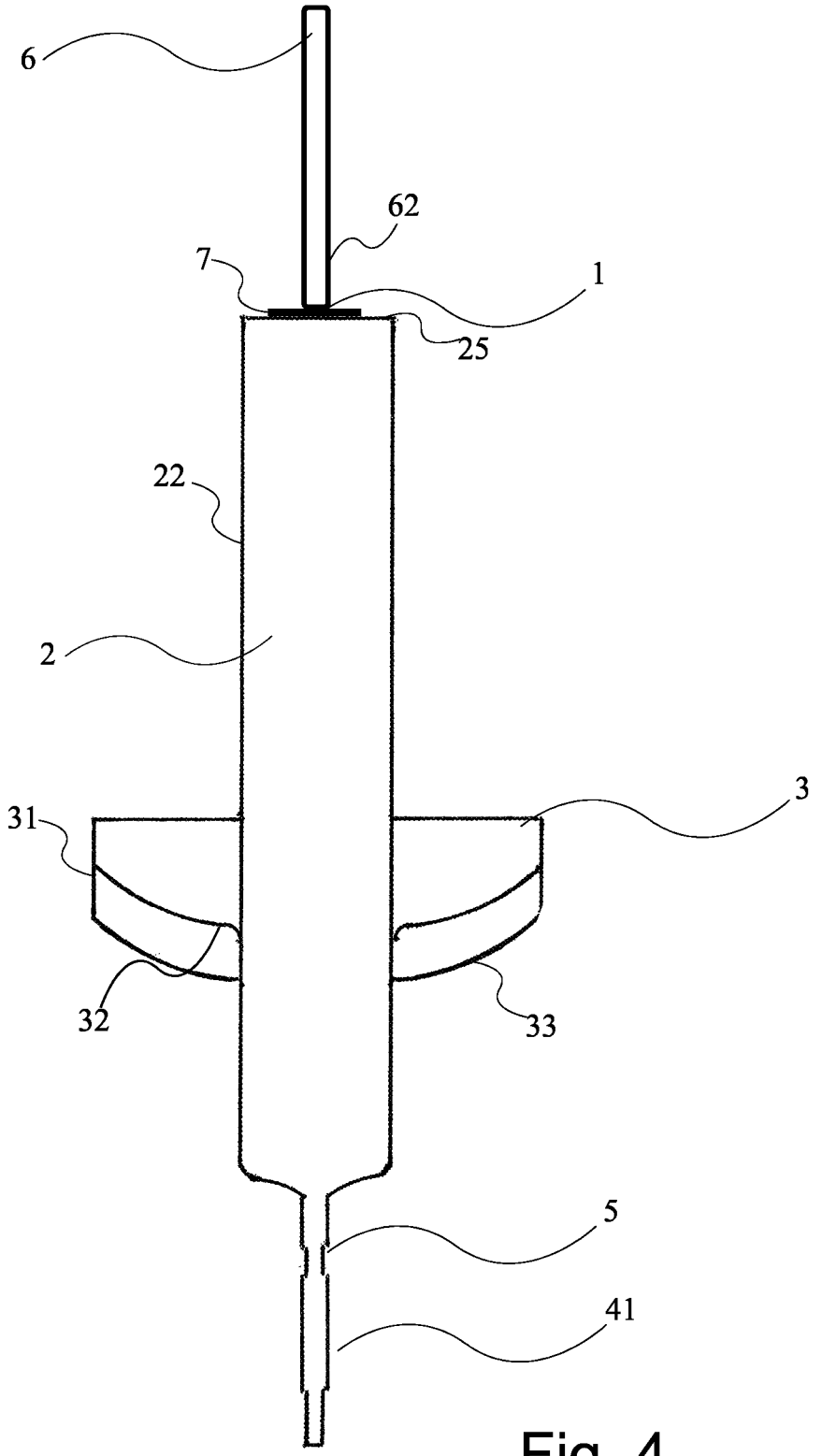
FIG. 4 shows a front view of the present invention.
Figure 5:
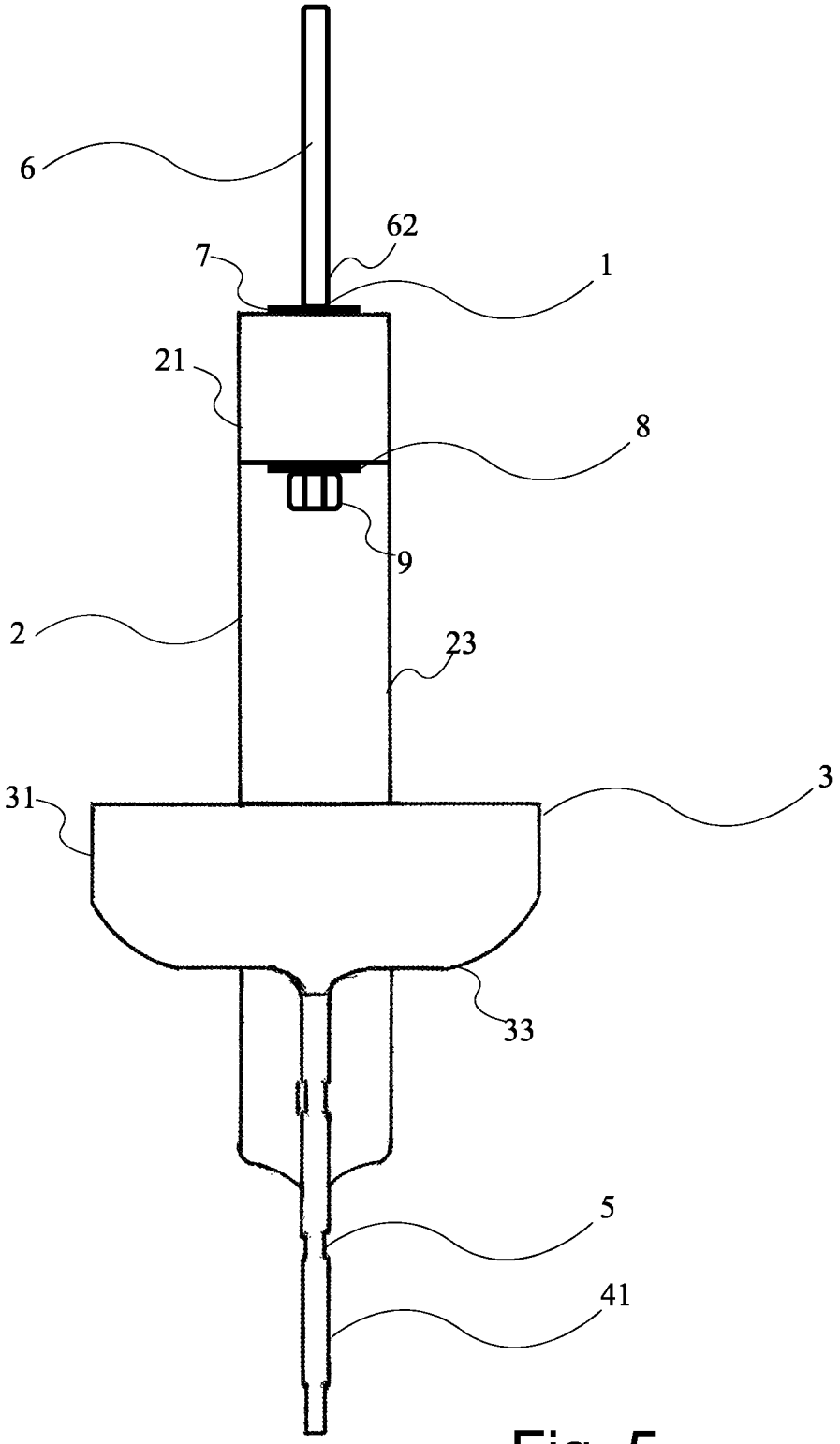
FIG. 5 shows a rear view of the present invention.
Figure 6:
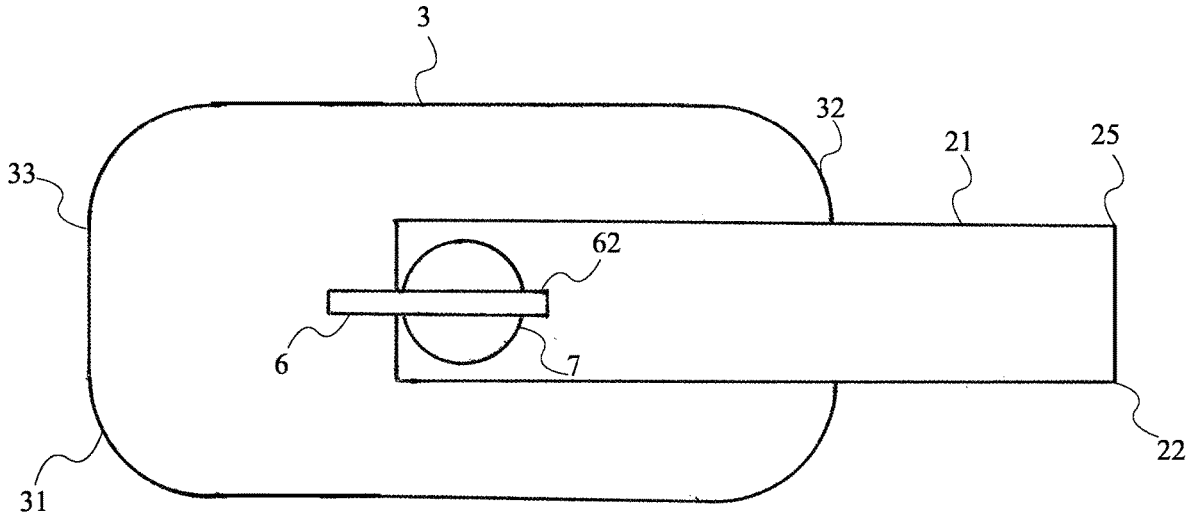
FIG. 6 shows a top-down view of the present invention.
Figure 7:
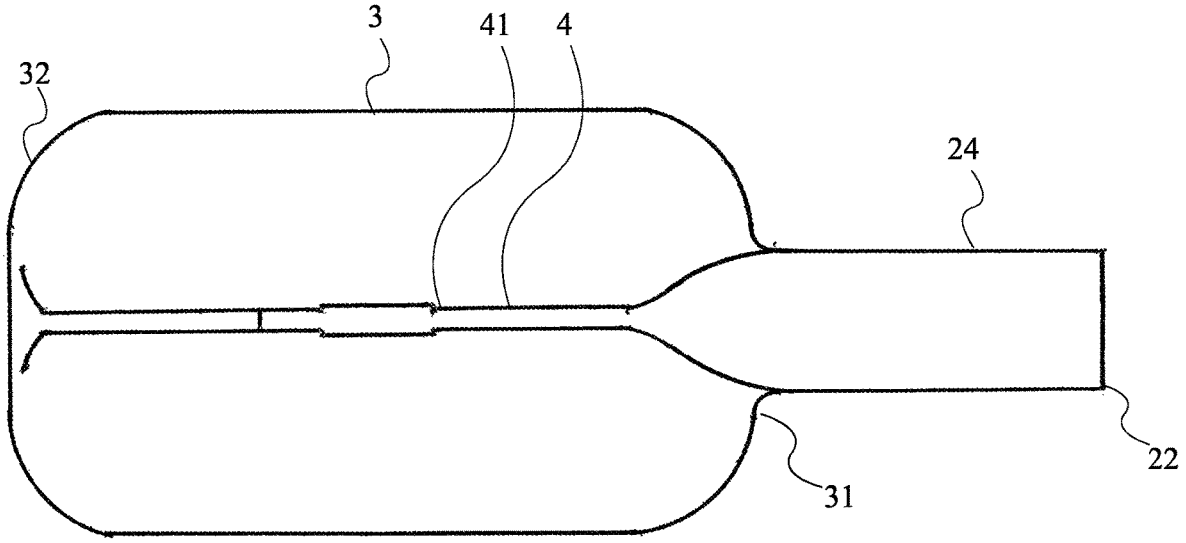
FIG. 7 shows a view of the bottom of the present invention.

As seen in FIG. 2, in the ideal embodiment, the hanger attachment mechanism 5 is a hole placed through the main body 4. The hole is positioned and sized such that the hook of a clothes hanger may be placed through the hole. If a hooded garment is placed upon the clothes hanger, the hanger attachment mechanism 5 is positioned such that the hood of the garment can be pulled upwards to rest on the garment hood support 3.

The shaped structural member 2 comprises a flat portion 21, a curved outer edge 22, an inner cavity 23, a first end 24, and a second end 25. The first end 24 of the shaped structural member 2 is contiguously attached to the main body 4. The inner cavity 23 is a curved surface that curves upwards from the main body 4 and creates an inner curve of the shaped structural member 2. The inner cavity 23 is positioned in proximity to the garment hood support 3, such that the hood of a garment may rest on the inner cavity 23 when the present invention is in use, if the hood is too long to rest on the garment hood support 3 alone. The curved outer edge 22 of the structural support runs parallel to the inner cavity 23, forming the outside curve along the inner cavity 23. In the ideal embodiment, the inner cavity 23 and curved outer edge 22 form a single, consistent uniform curve. The inner cavity 23 and curved outer edge 22 are connected by the structural cross webbing 10. The second end 25 of the shaped structural member 2 is contiguously attached to a flat portion 21 that extends above the main body 4. In the ideal embodiment, the flat portion 21 is rectangular in shape, though other shapes are contemplated. As seen in FIG. 2, in the ideal embodiment, the flat portion 21 is positioned vertically above the main body 4, and the flat portion 21 is positioned parallel to the garment hood support 3. The flat portion 21 of the shaped structural member 2 further comprises a swivel hook attachment hole 1.

The structural cross webbing 10 comprises at least one raised platform 102 that connects the curved outer edge 22 and inner cavity 23, providing support to the shaped structural member 2 and ensuring that the shaped structural member 2 does not bend or break when in use with a heavy garment. In the ideal embodiment, each raised platform 102 of the structural cross webbing 10 is positioned to have a small space 101 between the end points of each of the structural cross webbing 10. This positioning creates a design that is easier to manufacture and is less likely to have structural problems resulting from an abundance of material at the junctions of the cross-webbing.

The swivel hook attachment hole 1 is a hole that is placed through the flat portion 21 of the shaped structural member 2 that is adapted to receive a swivel hook 6. As seen in FIG. 2, the swivel hook 6 can be fastened to the shaped structural member 2 with a top washer 7, a bottom washer 8, and a bottom locking nut 9. In the ideal embodiment, the bottom locking nut 9 is adapted so that it can be tightened and loosened at will. When the bottom locking nut 9 is loosened, the swivel hook 6 can freely rotate in all directions. When the bottom locking nut 9 is tightened, the swivel hook 6 is held in place and cannot freely rotate.

As seen in FIG. 2, in the ideal embodiment, the swivel hook 6 comprises a curved member that has at least two parallel sections 61. This design allows the swivel hook 6 to adapt to many different, common cross-bar designs that are used in typical closets. The swivel hook 6 may have a small swage 62 at the base of the hook, the swage 62 being located near the point at which the swivel hook 6 attaches to the specially shaped structural member 2. The swage 62 is a small protrusion in the material of the swivel hook 6. The swage 62 prevents the top washer 7 from riding too far up the swivel hook 6, helping keep the swivel hook 6 in place when the present invention is in use.

The garment hood support 3 is positioned on top of the main body 4. The garment hood support 3 comprises a proximal side 32, a distal side 33, and edges 31. In the ideal embodiment, the garment hood support 3 has a convex curve in relation to the main body 4, the center of the garment hood support 3 bending upwards while the proximal side 32 and the distal side 33 bend downwards. This configuration is well-adapted to receive the hood of a garment, allowing the hood to rest in a natural and relaxed state, avoiding undue stress on the material. The edges 31 of the garment hood support 3 have a slight downward curve towards the main body 4 to further contribute to the ability of the configuration to allow a hood to rest naturally.

Although the invention has been explained in relation to its preferred embodiment, it is to be understood that many other possible modifications and variations can be made without departing from the spirit and scope of the invention.

What is claimed is:

1. A garment hanger attachment device, comprising:
- a main body;
- a hanger attachment mechanism;
- a garment hood support having a proximal side and a distal side;
- a shaped structural member having a first end and a second end;
- a swivel hook;
- the main body further comprising a central vertical flat section;
- the hanger attachment mechanism being positioned on the central vertical flat section;
- wherein the hanger attachment mechanism is structured to enable one or more hangers to have their hanging structure rest upon or be inserted into the hanger attachment mechanism;
- wherein the garment hood support is attached contiguously with the main body;
- wherein the proximal side of the garment hood support is contiguously connected to the shaped structural member at the first end of the shaped structural member;
- wherein the shaped structural member protrudes from the main body;
- wherein the shaped structural member is attached to the main body at the first end; and
- wherein the swivel hook is positioned on the shaped structural member.

2. The garment hanger attachment device of claim 1, further comprising:
- the shaped structural member further comprising a flat portion, a curved outer edge, and an inner cavity;
- the flat portion of the shaped structural member further comprising a swivel hook attachment hole; and
- wherein the swivel hook attachment hole is located on the flat portion of the shaped structural member.

3. The garment hanger attachment device of claim 2, further comprising:
- a bottom washer;
- a top washer;
- a locking nut;
- wherein the swivel hook is attached to the swivel hook attachment hole of the shaped structural member; and
- wherein the swivel hook is secured in the swivel hook attachment hole with a top washer, a bottom washer, and a bottom locking nut.

4. The garment hanger attachment device of claim 3, further comprising:
- the swivel hook further comprising at least two parallel sections.

5. The garment hanger attachment device of claim 4, further comprising:
- wherein the swivel hook can rotate freely when the bottom locking nut is loosened;
- wherein the swivel hook is held in place when the bottom locking nut is tightened; and
- wherein the swivel hook further comprises a swage located at the bottom of the swivel hook.

6. The garment hanger attachment device of claim 2, further comprising:

wherein the shaped structural member further comprises structural cross webbing; and the structural cross webbing comprising a plurality of raised platforms connecting the inner cavity of the shaped structural member to the curved outer edge of the shaped structural member.

7. The garment hanger attachment device of claim 6, further comprising:

wherein the inner cavity and the curved outer edge form a curve of uniform width; and wherein the plurality of raised platforms have a small space between each connection.

8. The garment hanger attachment device of claim 7, further comprising:

wherein the flat portion of the shaped structural member is located at the second end of the shaped structural member;

wherein the flat portion is positioned vertically above the main body; and wherein the flat portion is positioned parallel to the garment hood support.

9. The garment hanger attachment device of claim 1, further comprising:

the hanger attachment mechanism being a hanger attachment hole.

10. The garment hanger attachment device of claim 9, further comprising:

a plurality of hanger attachment mechanisms; and wherein the plurality of hanger attachment mechanisms is spaced vertically to accommodate garments of varying sizes.

11. The garment hanger attachment device of claim 1, further comprising:

wherein the garment hood support is positioned above the main body; and wherein the garment hood support is curved to be convex in relation to the main body.

12. The garment hanger attachment device of claim 11, further comprising:

the garment hood support further comprising edges; and the edges of the garment hood support being rounded downwards towards the main body.

13. A garment hanger attachment device, comprising:

a main body;

a hanger attachment mechanism;

a garment hood support having a proximal side and a distal side;

a shaped structural member having a first end and a second end;

a swivel hook;

the main body further comprising a central vertical flat section;

the hanger attachment mechanism being positioned on the central vertical flat section;

wherein the garment hood support is attached contiguously with the main body;

wherein the proximal side of the garment hood support is contiguously connected to the shaped structural member at the first end of the shaped structural member;

wherein the shaped structural member protrudes from the main body;

wherein the shaped structural member is attached to the main body at the first end;

wherein the swivel hook is positioned on the shaped structural member;

the shaped structural member further comprising a flat portion, a curved outer edge, and an inner cavity;

the flat portion of the shaped structural member further comprising a swivel hook attachment hole;

wherein the swivel hook attachment hole is located on the flat portion of the shaped structural member;

a bottom washer;

a top washer;

a locking nut;

wherein the swivel hook is attached to the swivel hook attachment hole of the shaped structural member;

wherein the swivel hook is secured in the swivel hook attachment hole with a top washer, a bottom washer, and a bottom locking nut;

the swivel hook further comprising at least two parallel sections;

wherein the garment hood support is positioned above the main body;

wherein the garment hood support is curved to be convex in relation to the main body;

wherein the shaped structural member further comprises structural cross webbing;

the structural cross webbing comprising a plurality of raised platforms connecting the inner cavity of the shaped structural member to the curved outer edge of the shaped structural member;

the hanger attachment mechanism being a hanger attachment hole;

wherein the flat portion of the shaped structural member is located at the second end of the shaped structural member;

wherein the flat portion is positioned vertically above the main body; and wherein the flat portion is positioned parallel to the garment hood support.

14. The garment hanger attachment device of claim 13, further comprising:

wherein the swivel hook can rotate freely when the bottom locking nut is loosened;

wherein the swivel hook is held in place when the bottom locking nut is tightened; and wherein the swivel hook further comprises a swage located at the bottom of the swivel hook.

15. The garment hanger attachment device of claim 13, further comprising:

the garment hood support further comprising edges; and the edges of the garment hood support being rounded downwards towards the main body.

16. The garment hanger attachment device of claim 13, further comprising:

wherein the inner cavity and the curved outer edge form a curve of uniform width; and wherein the plurality of raised platforms have a small space between each connection.

17. The garment hanger attachment device of claim 13, further comprising:

a plurality of hanger attachment mechanisms; and wherein the plurality of hanger attachment mechanisms is spaced vertically to accommodate garments of varying sizes.

18. A garment hanger attachment device, comprising:

a main body;

a hanger attachment mechanism;

a garment hood support having a proximal side and a distal side;

a shaped structural member having a first end and a second end;

the shaped structural member further comprising a flat portion, a curved outer edge, and an inner cavity;

the flat portion of the shaped structural member further comprising a swivel hook attachment hole;

a swivel hook;

the swivel hook further comprising at least two parallel sections;

a bottom washer;

a top washer;

a locking nut;

the main body further comprising a central vertical flat section;

the hanger attachment mechanism being a hanger attachment hole;

the hanger attachment mechanism being positioned on the central vertical flat section;

wherein the garment hood support is attached contiguously with the main body;

wherein the garment hood support is positioned above the main body;

the garment hood support further comprising edges;

the edges of the garment hood support being rounded downwards towards the main body;

wherein the garment hood support is curved to be convex in relation to the main body;

wherein the proximal side of the garment hood support is contiguously connected to the shaped structural member at the first end of the shaped structural member;

wherein the shaped structural member protrudes from the main body;

wherein the shaped structural member is attached to the main body at the first end;

wherein the shaped structural member further comprises structural cross webbing;

the structural cross webbing comprising a plurality of raised platforms connecting the inner cavity of the shaped structural member to the curved outer edge of the shaped structural member;

wherein the inner cavity and the curved outer edge form a curve of uniform width;

wherein the plurality of raised platforms have a small space between each connection;

wherein the flat portion of the shaped structural member is located at the second end of the shaped structural member;

wherein the flat portion is positioned vertically above the main body;

wherein the flat portion is positioned parallel to the garment hood support;

wherein the swivel hook attachment hole is located on the flat portion of the shaped structural member;

wherein the swivel hook is attached to the swivel hook attachment hole of the shaped structural member;

where in the swivel hook is secured in the swivel hook attachment hole with a top washer, a bottom washer, and a bottom locking nut;

wherein the swivel hook can rotate freely when the bottom locking nut is loosened;

wherein the swivel hook is held in place when the bottom locking nut is tightened; and wherein the swivel hook further comprises a swage located at the bottom of the swivel hook.

19. The garment hanger attachment device of claim 18, further comprising:

a plurality of hanger attachment mechanisms; and wherein the plurality of hanger attachment mechanisms are spaced vertically to accommodate garments of varying sizes.

* * * * *